US006983242B1

(12) United States Patent
Thyssen

(10) Patent No.: US 6,983,242 B1
(45) Date of Patent: Jan. 3, 2006

(54) METHOD FOR ROBUST CLASSIFICATION IN SPEECH CODING

(75) Inventor: Jes Thyssen, Laguna Niguel, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 563 days.

(21) Appl. No.: 09/643,017

(22) Filed: Aug. 21, 2000

(51) Int. Cl.
*G10L 11/00* (2006.01)
*G10L 21/02* (2006.01)

(52) U.S. Cl. ..... 704/208; 704/226; 704/233

(58) Field of Classification Search ..... 704/207–210, 704/212–215, 219–221, 226, 233
See application file for complete search history.

(56) References Cited

U.S. PATENT DOCUMENTS 5,459,814 A * 10/1995 Gupta et al. ..... 704/233
5,491,771 A * 2/1996 Gupta et al. ..... 704/223
5,633,982 A * 5/1997 Ganesan et al. ..... 704/233
6,003,001 A * 12/1999 Maeda ..... 704/223
6,233,550 B1 * 5/2001 Gersho et al. ..... 704/208
6,240,386 B1 * 5/2001 Thyssen et al. ..... 704/220
6,453,289 B1 * 9/2002 Ertem et al. ..... 704/225
6,636,829 B1 * 10/2003 Benyassine et al. ..... 704/201

OTHER PUBLICATIONS

Applicant is not aware of any patents, publications, or other information for consideration by the Patent Office.

* cited by examiner

*Primary Examiner*—Abul K. Azad
(74) *Attorney, Agent, or Firm*—Farjami & Farjami LLP

(57) ABSTRACT

A method for robust speech classification in speech coding and, in particular, for robust classification in the presence of background noise is herein provided. A noise-free set of parameters is derived, thereby reducing the adverse effects of background noise on the classification process. The speech signal is identified as speech or non-speech. A set of basic parameters is derived for the speech frame, then the noise component of the parameters is estimated and removed. If the frame is non-speech, the noise estimations are updated. All the parameters are then compared against a predetermined set of thresholds. Because the background noise has been removed from the parameters, the set of thresholds is largely unaffected by any changes in the noise. The frame is classified into any number of classes, thereby emphasizing the perceptually important features by performing perceptual matching rather than waveform matching.

8 Claims, 4 Drawing Sheets

METHOD FOR ROBUST CLASSIFICATION IN SPEECH CODING

FIELD OF INVENTION

The present invention relates generally to a method for improved speech classification and, more particularly, to a method for robust speech classification in speech coding.

BACKGROUND OF THE INVENTION

With respect to speech communication, background noise can include passing motorists, overhead aircraft, babble noise such as restaurant/café type noises, music, and many other audible noises. Cellular telephone technology brings the ease of communicating anywhere a wireless signal can be received and transmitted. However, the downside with the so called "cellular-age" is that phone conversations may no longer be private or in an area where communication is even feasible. For example, if a cell phone rings and the user answers it, speech communication is effectuated whether the user is in a quiet park or near a noisy jackhammer. Thus, the effects of background noise are a major concern for cellular phone users and providers.

Classification is an important tool in speech processing. Typically, the speech signal is classified into a number of different classes, for among other reasons, to place emphasis on perceptually important features of the signal during encoding. When the speech is clean or free from background noise, robust classification (i.e., low probability of misclassifying frames of speech) is more readily realized. However, as the level of background noise increases, efficiently and accurately classifying the speech becomes a problem.

In the telecommunication industry, speech is digitized and compressed per ITU (International Telecommunication Union) standards, or other standards such as wireless GSM (global system for mobile communications). There are many standards depending upon the amount of compression and application needs. It is advantageous to highly compress the signal prior to transmission because as the compression increases, the bit rate decreases. This allows more information to transfer in the same amount of bandwidth thereby saving bandwidth, power and memory. However, as the bit rate decreases, a faithful reproduction of the speech becomes increasingly more difficult. For example, for telephone application (speech signal with frequency bandwidth of around 3.3 kHz) digital speech signal is typically 16 bits linear or 128 kbits/s. ITU-T standard G.711 is operating at 64 Kbits/s or half of the linear PCM (pulse coding modulation) digital speech signal. The standards continue to decrease in bit rate as demands for bandwidth rise (e.g., G.726 is 32 kbits/s; G.728 is 16 kbits/s; G.729 is 8 kbits/s). A standard is currently under development that will decrease the bit rate even lower to 4 kbits/s.

Typically, speech is classified based on a set of parameters, and for those parameters, a threshold level is set for determining the appropriate class. When background noise is in the environment (e.g., additive speech and noise at the same time), the parameters derived for classification typically overlay or add due to the noise. Present solutions include estimating the level of background noise in a given environment and, depending on that level, varying the thresholds. One problem with these techniques is that the control of the thresholds adds another dimension to the classifier. This increases the complexity of adjusting the thresholds and finding an optimal setting for all noise levels is not generally practical.

For instance, a commonly derived parameter is pitch correlation, which relates to how periodic the speech is. Even in highly voiced speech, such as the vowel sound "a", when background noise is present, the periodicity appears to be much less due to the random character of the noise.

Complex algorithms are known in the art which purport to estimate parameters based on a reduced noise signal. In one such algorithm, for example, a complete noise compression algorithm is run on a noise-contaminated signal. The parameters are then estimated on the reduced noise signal. However, these algorithms are very complex and consume power and memory from the digital signal processor (DSP).

Accordingly, there is a need for a less complex method for speech classification which is useful at low bit rates. In particular, there is a need for an improved method for speech classification whereby the parameters are not influenced by the background noise.

SUMMARY OF THE INVENTION

The present invention overcomes the problems outlined above and provides a method for improved speech communication. In particular, the present invention provides a less complex method for improved speech classification in the presence of background noise. More particularly, the present invention provides a robust method for improved speech classification in speech coding whereby the effects of the background noise on the parameters are reduced.

In accordance with one aspect of the present invention, a homogeneous set of parameters, independent of the background noise level, is obtained by estimating the parameters of the clean speech.

BRIEF DESCRIPTION OF THE DRAWINGS

These and other features, aspects and advantages of the present invention will become better understood with reference to the following description, appending claims, and accompanying drawings where:

DETAILED DESCRIPTION OF PREFERRED EMBODIMENTS

The present invention relates to an improved method for speech classification in the presence of background noise. Although the methods for speech communication and, in particular, the methods for classification presently disclosed are particularly suited for cellular telephone communication, the invention is not so limited. For example, the method for classification of the present invention may be well suited for a variety of speech communication contexts such as the PSTN (public switched telephone network), wireless, voice over IP (internet protocol), and the like.

Unlike the prior art methods, the present invention discloses a method which represents the perceptually important features of the input signal and performs perceptual matching rather than waveform matching. It should be understood that the present invention represents a method for speech classification which may be one part of a larger speech coding algorithm. Algorithms for speech coding are widely known in the industry. It should be appreciated that one skilled in the art will recognize that various processing steps may be performed both prior to and after the implementation of the present invention (e.g., the speech signal may be pre-processed prior to the actual speech encoding; common frame based processing; mode dependent processing; and decoding).

Figure 1:
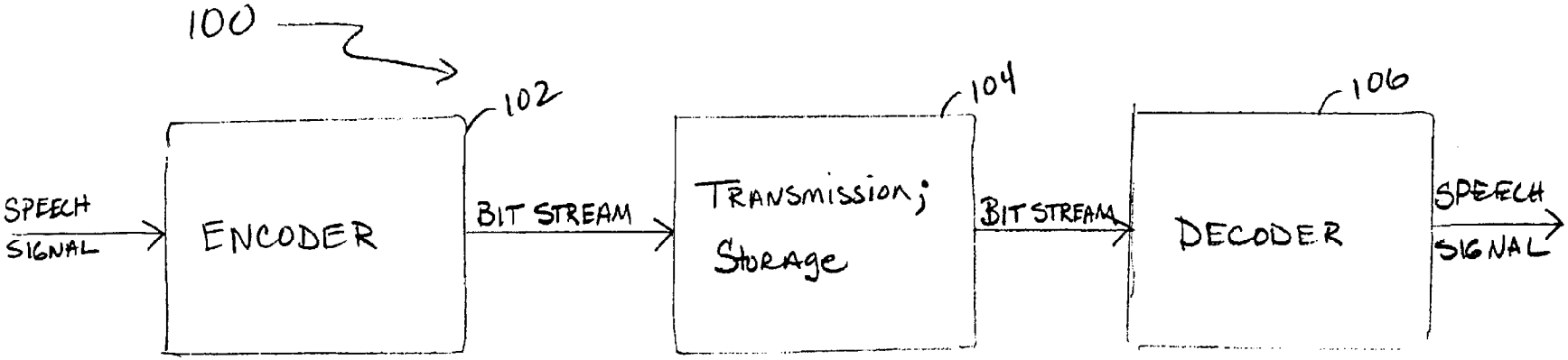
Figure 1 Prior Art
FIG. 1 illustrates, in block format, a simplified depiction of the typical stages of speech processing in the prior art.

By way of introduction, FIG. 1 broadly illustrates, in block format, the typical stages of speech processing known in the prior art. In general, the speech system 100 includes an encoder 102, transmission or storage 104 of the bit stream, and a decoder 106. Encoder 102 plays a critical role in the system, especially at very low bit rates. The pre-transmission processes are carried out in encoder 102, such as determining speech from non-speech, deriving the parameters, setting the thresholds, and classifying the speech frame. Typically, for high quality speech communication, it is important that the encoder (usually through an algorithm) consider the kind of signal and based upon the kind, process the signal accordingly. The specific functions of the encoder of the present invention will be discussed in detail below, however, in general, the encoder classifies the speech frame into any number of classes. The information contained in the class will help to further process the speech.

The encoder compresses the signal, and the resulting bit stream is transmitted 104 to the receiving end. Transmission (wireless or wireline) is the carrying of the bit stream from the sending encoder 102 to the receiving decoder 106. Alternatively, the bit stream may be temporarily stored for delayed reproduction or playback in a device such as an answering machine or voiced email, prior to decoding.

The bit stream is decoded in decoder 106 to retrieve a sample of the original speech signal. Typically, it is not realizable to retrieve a speech signal that is identical to the original signal, but with enhanced features (such as those provided by the present invention), a close sample is obtainable. To some degree, decoder 106 may be considered the inverse of encoder 102. In general, many of the functions performed by encoder 102 can also be performed in decoder 106 but in reverse.

Although not illustrated, it should be understood that speech system 100 may further include a microphone to receive a speech signal in real time. The microphone delivers the speech signal to an A/D (analog to digital) converter where the speech is converted to a digital form then delivered to encoder 102. Additionally, decoder 106 delivers the digitized signal to a D/A (digital to analog) converter where the speech is converted back to analog form and sent to a speaker.

Like the prior art, the present invention includes an encoder or similar device which includes an algorithm based on a CELP (Code Excited Linear Prediction) model. However, in order to achieve toll quality at low bit rates (e.g., 4 kbits/s) the algorithm departs somewhat from the strict waveform-matching criterion of known CELP algorithms and strives to catch the perceptually important features of the input signal. While the present invention may be but one single part of an eX-CELP (eXtended CELP) algorithm, it is helpful to broadly introduce the overall functions of the algorithm.

The input signal is analyzed according to certain features, such as, for example, degree of noise-like content, degree of spike-like content, degree of voiced content, degree of unvoiced content, evolution of magnitude spectrum, evolution of energy contour, and evolution of periodicity. This information is used to control weighting during the encoding/quantization process. The general philosophy of the present method may be characterized as accurately representing the perceptually important features by performing perceptual matching rather than waveform matching. This is based, in part, on the assumption that at low bit rates waveform matching is not sufficiently accurate to faithfully capture all information in the input signal. The algorithm, including the present invention section, may be implemented in C-code or any other suitable computer or device language known in the industry such as assembly. While the present invention is conveniently described with respect to the eX-CELP algorithm, it should be appreciated that the method for improved speech classification herein disclosed may be but one part of an algorithm and may be used in similar known or yet to be discovered algorithms.

In one embodiment, a voice activity detection (VAD) is embedded in the encoder in order to provide information on the characteristic of the input signal. The VAD information is used to control several aspects of the encoder, including estimation of the signal to noise ratio (SNR), pitch estimation, some classification, spectral smoothing, energy smoothing, and gain normalization. In general, the VAD distinguishes between speech and non-speech input. Non-speech may include background noise, music, silence, or the like. Based on this information, some of the parameters can be estimated.

Figure 2:
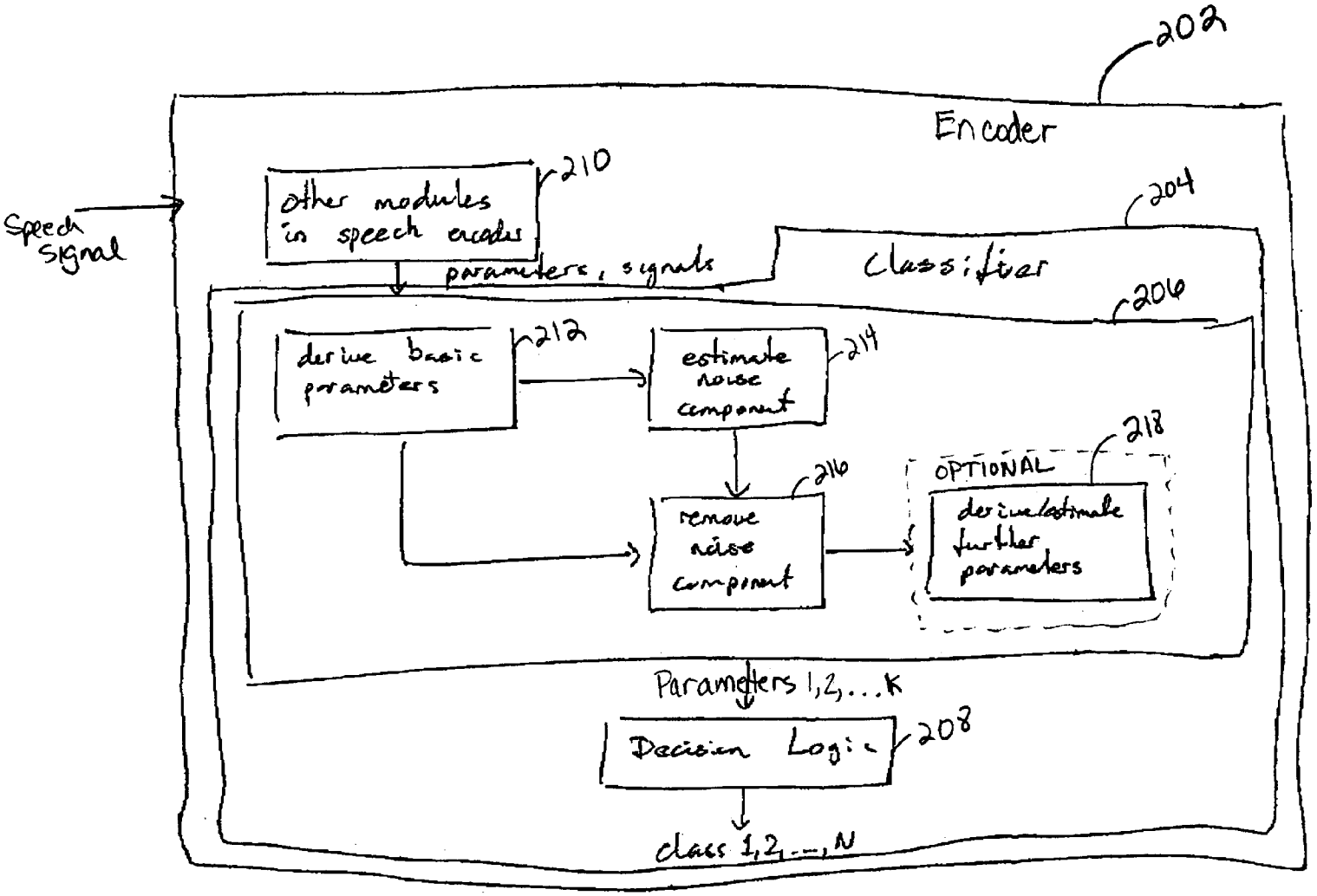
FIG. 2 illustrates, in block detail, an exemplary encoding system in accordance with the present invention.

Referring now to FIG. 2, an encoder 202 illustrates, in block format, the classifier 204 in accordance with one embodiment of the present invention. Classifier 204 suitably includes a parameter-deriving module 206 and a decision logic 208. Classification can be used to emphasize the perceptually important features during encoding. For example, classification can be used to apply different weight to a signal frame. Classification does not necessarily affect the bandwidth, but it does provide information to improve the quality of the reconstructed signal at the decoder (receiving end). However, in certain embodiments it does affect the bandwidth (bit-rate) by varying also the bit-rate according to the class information and not just the encoding process. If the frame is background noise, then it may be classified as such and it may be desirable to maintain the randomness characteristic of the signal. However, if the frame is voice speech, then it may be important to keep the periodicity of the signal. Classifying the speech frame provides the remaining part of the encoder with information to enable emphasis to be placed on the important features of the signal (i.e., "weighting").

Classification is based on a set of derived parameters. In the present embodiment, classifier 204 includes a parameter-deriving module 206. Once the set of parameters is derived for a particular frame of speech, the parameters are measured either alone or in combination with other parameters by decision logic 208. The details of decision logic 208 will be discussed below, however, in general, decision logic 208 compares the parameters to a set of thresholds.

By way of example, a cellular phone user may be communicating in a particularly noisy environment. As the level of background noise increases, the derived parameters may change. The present invention proposes a method which, on the parameter level, removes the contribution due to the background noise, thereby generating a set of parameters that are invariant to the level of background noise. In other words, one embodiment of the present invention includes deriving a set of homogeneous parameters instead of having parameters that vary with the level of background noise. This is particularly important when distinguishing between different kinds of speech, e.g. voiced speech, unvoiced speech, and onset, in the presence of background noise. To accomplish this, parameters for the noise contaminated signal are still estimated, but based on those parameters and information of the background noise, the component due to the noise contribution is removed. An estimation of the parameters of the clean signal (without noise) is obtained.

With continued reference to FIG. 2, the digital speech signal is received in encoder 202 for processing. There maybe occasions when other modules within encoder 210 can suitably derive some of the parameters, rather than classifier 204 re-deriving the parameters. In particular, a pre-processed speech signal (e.g., this may include silence enhancement, high-pass filtering, and background noise attenuation), the pitch lag and correlation of the frame, and the VAD information may be used as input parameters to classifier 204. Alternatively, the digitized speech signal or a combination of both the signal and other module parameters are input to classifier 204. Based on these input parameters and/or speech signals, parameter-deriving module 206 derives a set of parameters which will be used for classifying the frame.

In one embodiment, parameter-deriving module 206 includes a basic parameter-deriving module 212, a noise component estimating module 214, a noise component removing module 216, and an optional parameter-deriving module 218. In one aspect of the present embodiment, basic parameter-deriving module 212 derives three parameters, spectral tilt, absolute maximum, and pitch correlation, which can form the basis for the classification. However, it should be recognized that significant processing and analysis of the parameters may be performed prior to the final decision. These first few parameters are estimations of the signal having both the speech and noise component. The following description of parameter-deriving module 206 includes an example of preferred parameters, but in no way should it be construed as limiting. The examples of parameters with the accompanying equations are intended for demonstration and not necessarily as the only parameters and/or mathematical calculations available. In fact, one skilled in the art will be quite familiar with the following parameters and/or equations and may be aware of similar or equivalent substitutions which are intended to fall within the scope of the present invention.

Spectral tilt is an estimation of the first reflection coefficient four times per frame, given by:

$$\kappa(k) = \frac{\sum_{n=1}^{L-1} s_k(n)\cdot s_k(n-1)}{\sum_{n=0}^{L-1} s_k(n)^2} \quad k = 0, 1, \ldots, 3, \tag{1}$$

where L=80 is the window over which the reflection coefficient may be suitably calculated and $S_k(n)$ is the $k^{th}$ segment given by:

$$s_k(n)=s(k\cdot 40-20+n)\cdot w_h(n),\ n=0,1,\ldots 79, \tag{2}$$

where $w_h(n)$ is a 80 sample Hamming window known in the industry and s(0), s(1), . . . ,s(159) is the current frame of the pre-processed speech signal.

Absolute maximum is the tracking of absolute signal maximum eight estimates per frame, given by:

$$\chi(k)=\max\{|s(n)|, n=n_s(k), n_s(k)+1, \ldots, n_s(k)-1,\ k=0,1,\ldots,7 \tag{3}$$

where $n_s(k)$ and $n_s(k)$ are the starting point and ending point, respectively, for the search of the $k^{th}$ maximum at time k160/8 samples of the frame. In general, the length of the segment is 1.5 times the pitch period and the segments overlap. In this way, a smooth contour of the amplitude envelope is obtained.

Normalized standard deviation of pitch lag indicates the pitch period. For example, in voice speech the pitch period is stable, and for non-voice speech it is unstable:

$$\sigma_{L_p}(m) = \frac{1}{\mu_{L_p}(m)}\sqrt{\frac{\sum_{i=0}^{2}\left(L_p(m-2+l)-\mu_{L_p}(m)\right)^2}{3}}, \tag{4}$$

where $L_p(m)$ is the input pitch lag, and $\mu_{Lp}(m)$ is the mean of the pitch lag over the past three frames, given by:

$$\mu_{L_p}(m) = \frac{1}{3}\sum_{i=0}^{2}(L_p(m-2+l). \tag{5}$$

In one embodiment, noise component estimating module 214 is controlled by the VAD. For instance, if the VAD indicates that the frame is non-speech (i.e., background noise), then the parameters defined by noise component estimating module 214 are updated. However, if the VAD indicates that the frame is speech, then module 214 is not updated. The parameters defined by the following exemplary equations are suitably estimated/sampled 8 times per frame providing a fine time resolution of the parameter space.

Running mean of the noise energy is an estimation of the energy of the noise, given by:

$$\langle E_{N,p}(k)\rangle=\alpha_1\cdot\langle E_{N,p}(k\sim 1)\rangle+(1-\alpha_1)\cdot E_p(k), \tag{6}$$

where $E_{N,p}$ (k) is the normalized energy of the pitch period at time k·160/8 samples of the frame. It should be noted that the segments over which the energy is calculated may overlap since the pitch period typically exceeds 20 samples (160 samples/8).

Running mean of the spectral tilt of the noise, given by:

$$\langle\kappa_N(k)\rangle=\alpha_1\cdot\langle\kappa_N(k-1)\rangle+(1-\alpha_1)\cdot\kappa(k \bmod 2). \tag{7}$$

Running mean of the absolute maximum of the noise given by:

$$\langle\chi_N(k)\rangle=\alpha_1\cdot\langle\chi_N(k-1)\rangle+(1-\alpha_1)\cdot\chi(k). \tag{8}$$

Running mean of the pitch correlation of the noise given by:

$$\langle R_{N,p}(k)\rangle=\alpha_1\cdot\langle R_{N,p}(k-1)\rangle+(1-\alpha_1)\cdot R_p, \tag{9}$$

where $R_p$ is the input pitch correlation of the frame. The adaptation constant α is preferably adaptive, though a typical value is a α=0.99.

The background noise to signal ratio may be calculated according to:

$$\gamma(k) = \sqrt{\frac{\langle E_{N,p}(k)\rangle}{E_p(k)}}. \tag{10}$$

Parametric noise attenuation is suitably limited to an acceptable level, e.g., about 30 dB, i.e.

$$\gamma(k)=\{(k)>0.968?0.968:\gamma(k)\} \tag{11}$$

Noise removing module 216 applies weighting to the three basic parameters according to the following exemplary equations. The weighting removes the background noise component in the parameters by subtracting the contributions from the background noise. This provides a noise-free set of parameters (weighted parameters) that are independent from any background noise, are more uniform, and improve the robustness of the classification in the presence of background noise.

Weighted spectral tilt is estimated by:

$$\kappa_w(k)=\kappa(k \bmod 2)-\gamma(k)\cdot<\kappa_N(k)>. \tag{12}$$

Weighted absolute maximum is estimated by:

$$\chi_w(k)=\chi(k)-\gamma(k)\cdot<\chi_N(k)>. \tag{13}$$

Weighted pitch correlation is estimated by:

$$R_{w,p}(k)=R_p-\gamma(k)\cdot<R_{N,p}(k)>. \tag{14}$$

The derived parameters may then be compared in decision logic 208. Optionally, it may be desirable to derive one or more of the following parameters depending upon the particular application. Optional module 218 includes any number of additional parameters which may be used to further aid in classifying the frame. Again, the following parameters and/or equations are merely intended as exemplary and are in no way intended as limiting.

In one embodiment, it may be desirable to estimate the evolution of the frame in accordance with one or more of the previous parameters. The evolution is an estimation over an interval of time (e.g., 8 times/frame) and is a linear approximation.

Evolution of the weighted tilt as the slope of the first order approximation, given by:

$$\partial\kappa_w(k)=\frac{\sum_{i=1}^{7} l\cdot(\kappa_w(k-7+l)-\kappa_w(k-7))}{\sum_{i=1}^{7} l^2}. \tag{15}$$

Evolution of the weighted maximum as the slope of the first order approximation, given by:

$$\partial\chi_w(k)=\frac{\sum_{i=1}^{7} l\cdot(\chi_w(k-7+l)-\chi_w(k-7))}{\sum_{i=1}^{7} l^2}. \tag{16}$$

In yet another embodiment, once the parameters of equations 6 through 16 are updated for the exemplary eight sample points of the frame, the following frame based parameters may be calculated:

Maximum weighted pitch correlation (maximum of the frame), given by:

$$R_{w,p}^{max}=\max\{R_{w,p}(k-7+l),l=0,1,\ldots,7\}. \tag{17}$$

Average weighted pitch correlation given by:

$$R_{w,p}^{avg}=\frac{1}{8}\sum_{i=0}^{7} R_{w,p}(k-7+l). \tag{18}$$

Running mean of average weighted pitch correlation, given by:

$$<R_{w,p}^{avg}(m)>\alpha_2\cdot<R_{w,p}^{avg}(m-1)>+(1-\alpha_2)\cdot R_{w,p}^{avg}, \tag{19}$$

where m is the frame number and $\alpha_2=0.75$ is an exemplary adaptation constant Minimum weighted spectral tilt, given by:

$$\kappa_{wt}^{min}=\min\{\kappa_w(k-7+l),l=0,1,\ldots,7\}. \tag{20}$$

Running mean of minimum weighted spectral tilt, given by:

$$<\kappa_w^{min}(m)>\alpha_2\cdot<\kappa_w^{min}(m-1)>+(1-\alpha_2)\cdot\kappa_w^{min}. \tag{21}$$

Average weighted spectral tilt, given by:

$$\kappa_w^{avg}=\frac{1}{8}\sum_{i=0}^{7}\kappa_w(k-7+l). \tag{22}$$

Minimum slope of weighted tilt (indicates the maximum evolution in the direction of negative spectral tilt in the frame) given by:

$$\partial\kappa_w^{min}=\min\{\partial\kappa_w(k-7+l),l=0,1,\ldots,7\}. \tag{23}$$

Accumulated slope of weighted spectral tilt (indicates the overall consistency of the spectral evolution), given by:

$$\partial\kappa_w^{acc}=\sum_{i=0}^{7}\partial\kappa_w(k-7+l). \tag{24}$$

Maximum slope of weighted maximum, given by:

$$\partial\chi_w^{max}=\max\{\partial\chi_w(k-7+l),l=0,1,\ldots,7\}. \tag{25}$$

Accumulated slope of weighted maximum, given by:

$$\partial\chi_w^{acc}=\sum_{i=0}^{7}\partial\chi_w(k-7+l). \tag{26}$$

In general, the parameters given by equations 23, 25 and 26 may be used to mark whether a frame is likely to contain an onset (i.e., point where voiced speech starts). The parameters given by equations 4 and 18–22 may be used to mark whether a frame is likely to be dominated by voiced speech.

Figure 3:
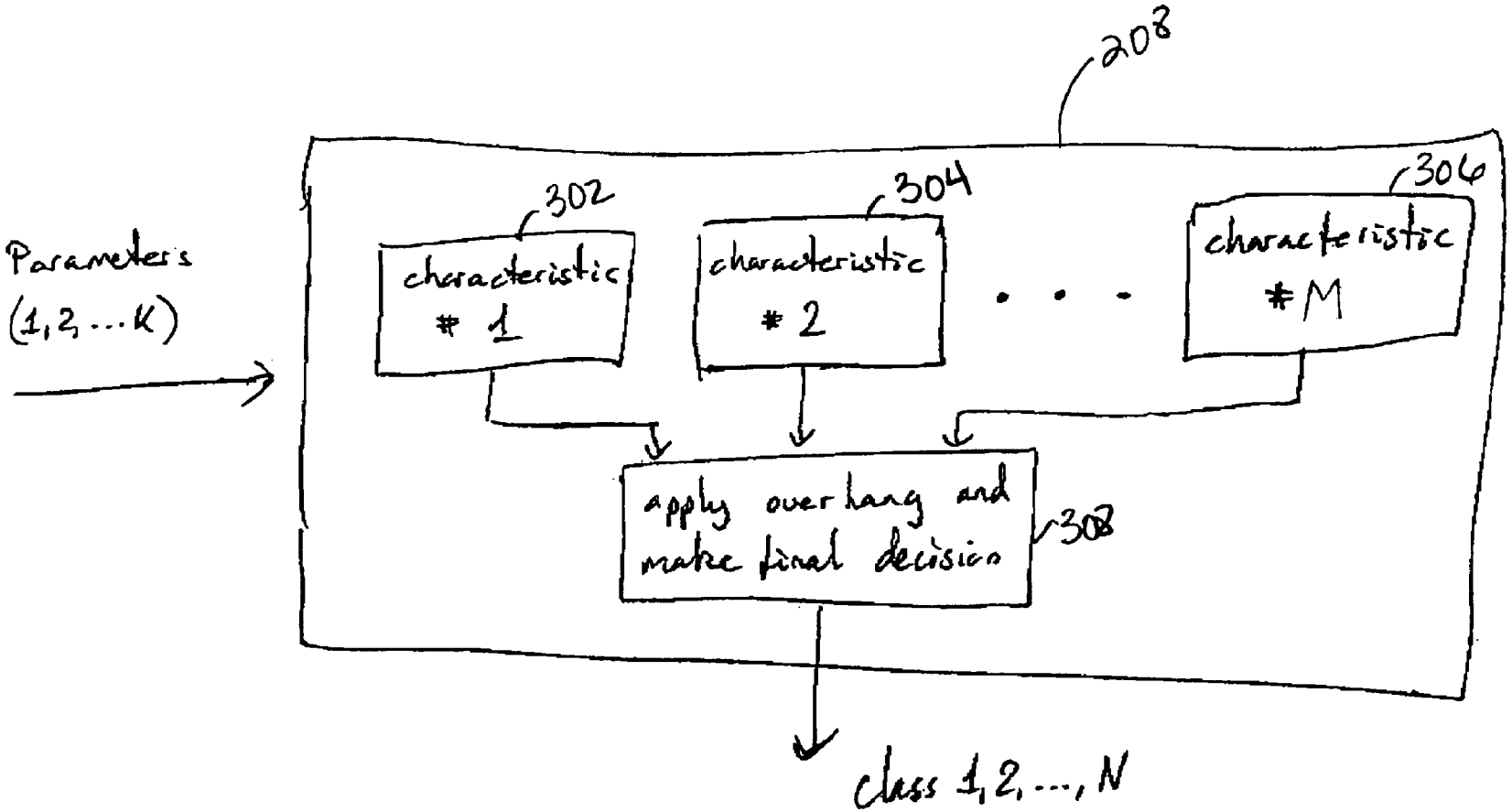
FIG. 3 illustrates, in block detail, an exemplary decision logic of FIG. 2.

Referring now to FIG. 3, decision logic 208 is illustrated in block format according to one embodiment of the present invention. Decision logic 208 is a module designed to compare all the parameters with a set of thresholds. Any number of desired parameters, illustrated generally as (1, 2, . . . k), may be compared in decision logic 208. Typically, each parameter or a group of parameters will identify a particular characteristic of the frame. For example, characteristic #1 302 may be speech vs. non-speech detection. In one embodiment, the VAD may indicate exemplary characteristic #1. If the VAD determines the frame is speech, the speech is typically further identified as voiced (vowels) vs. unvoiced (e.g., "s"). Characteristic #2 304 may be, for example, voiced vs. unvoiced speech detection. Any number of characteristics may be included and may comprise one or more of the derived parameters. For example, generally identified characteristic #M 306 may be onset detection and may comprise derived parameters from equations 23, 25 and 26. Each characteristic may set a flag or the like to indicate the characteristic has or has not been identified.

The final decision as to which class the frame belongs is preferably decided in a final decision module 308. All of the flags are received and compared with priority, e.g., the VAD as highest priority in module 308. In the present invention, the parameters are derived from the speech itself and are free from the influence of background noise; therefore, the thresholds are typically unaffected by changing background noise. In general, a series of "if-then" statements may compare each flag or a group of flags. For example, assuming each characteristic (flag) is represented by a parameter, in one embodiment, an "if" statement may read; "if parameter 1 is less than a threshold, then place in class X." In another embodiment, the statement may read; "if parameter 1 is less than a threshold and parameter 2 is less than a threshold and so on, then place in class X." In yet another embodiment, the statement may read; "if parameter 1 times parameter 2 is less than a threshold, then place in class X." One skilled in the art can readily recognize that any number of parameters either alone or in combination can be included in an appropriate "if-then" statement. Of course, there may be equally effective methods for comparing the parameters, all of which are intended to be included in the scope of the invention.

Additionally, final decision module 308 may include an overhang. Overhang, as used herein, shall have the meaning common in the industry. In general, overhang means that the history of the signal class is considered, i.e., after certain signal classes that same signal class is favored somewhat, e.g., at a gradual transition from voiced to unvoiced the voiced class is favored somewhat in order not to classify the segments with a low degree of voiced speech as unvoiced too early.

By way of demonstration, a brief description of some exemplary classes will follow. It should be appreciated that the present invention may be used to classify speech into any number or combination of classes and the following description is included merely to introduce the reader to one possible set of classes.

The exemplary eX-CELP algorithm classifies the frame into one of 6 classes according to dominating features of the frame. The classes are labeled:

0. Silence/Background Nose
1. Noise-Like Unvoiced Speech
2. Unvoiced
3. Onset
4. Plosive, not used
5. Non-Stationary Voiced
6. Stationary Voiced In the illustrated embodiment, class 4 is not used, thus the number of classes is 6. In order to effectively make use of the information available in the encoder, the classification module may be configured so that it does not initially distinguish between classes 5 and 6. This distinction is instead done during another module outside of the classifier where additional information may be available. Furthermore, the classification module may not initially detect class 1, but may be introduced during another module based on additional information and the detection of noise-like unvoiced speech. Hence, in one embodiment, the classification module may distinguish between silence/background noise, unvoiced, onset, and voiced using class number 0, 2, 3 and 5 respectively.

Figure 4:
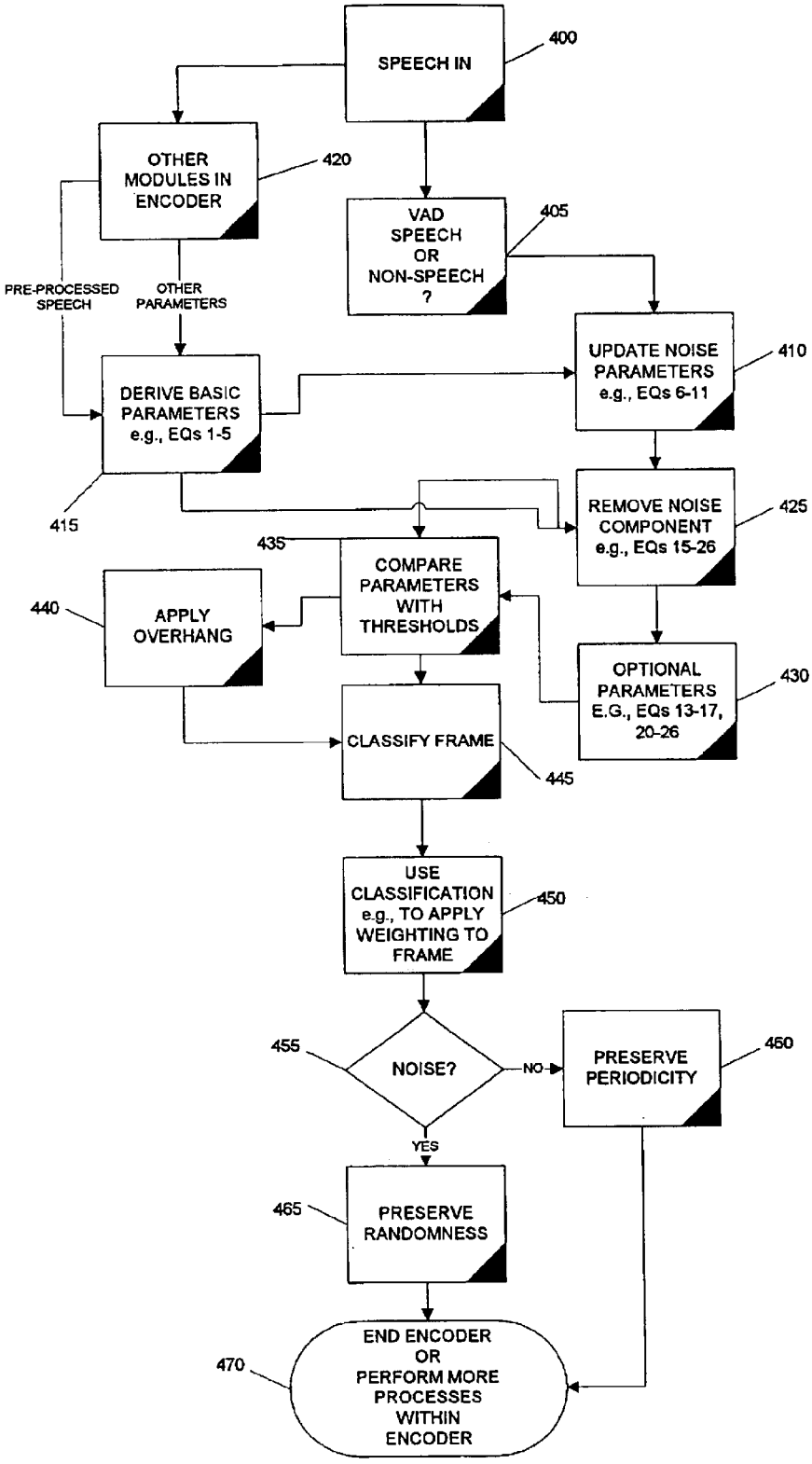
FIG. 4 is a flow chart of an exemplary method in accordance with the present invention.
Figure 1:
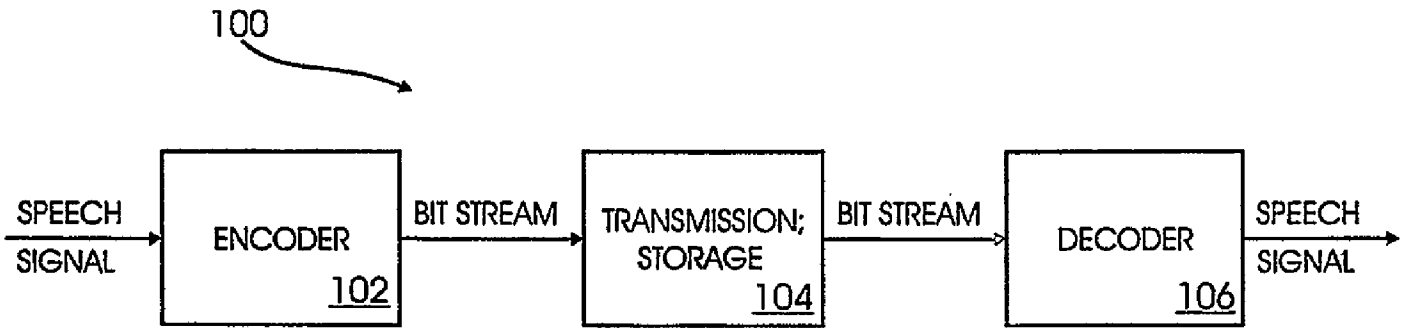
Fig. 1 Prior Art
Figure 2:
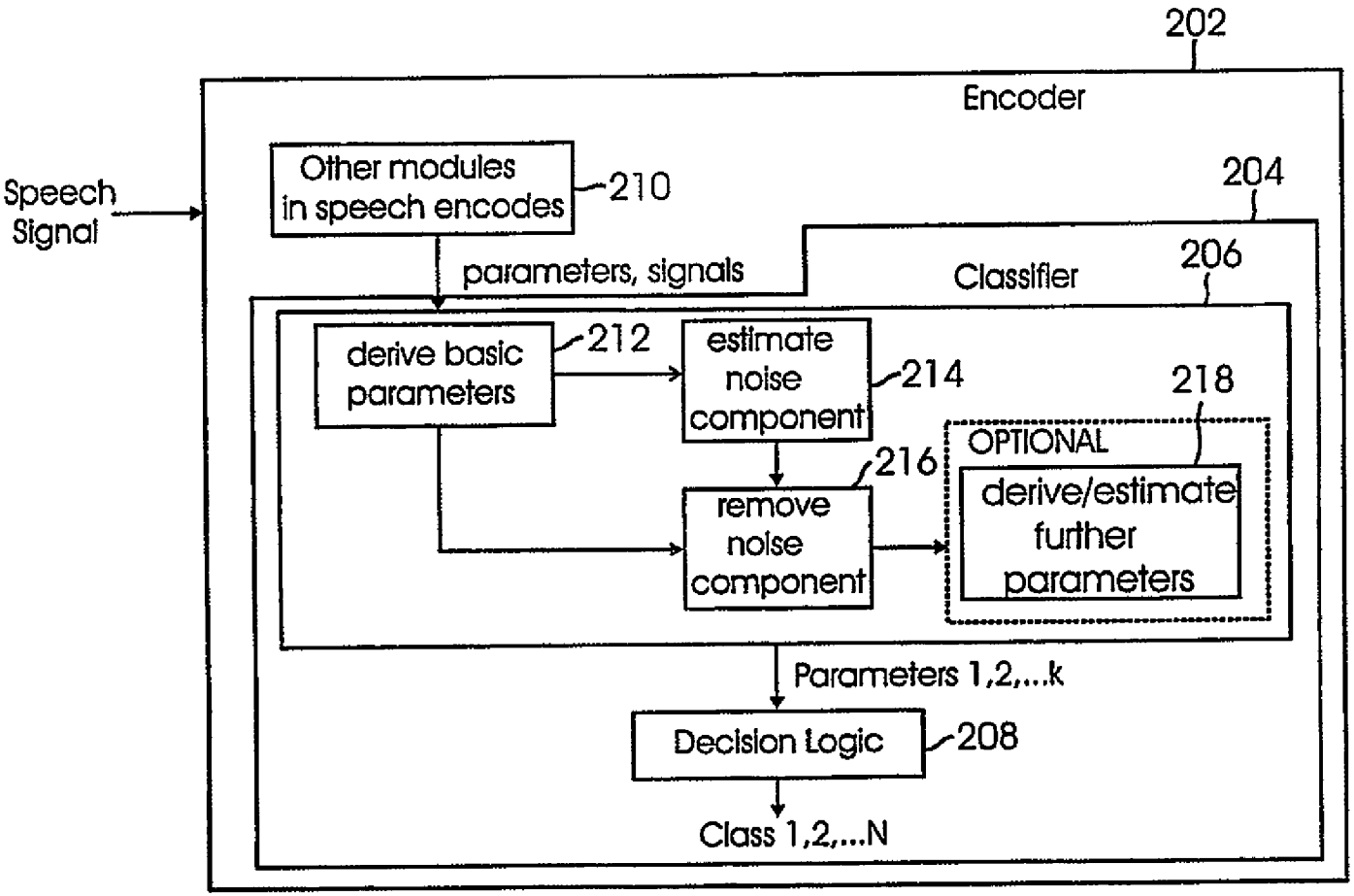
Figure 3:
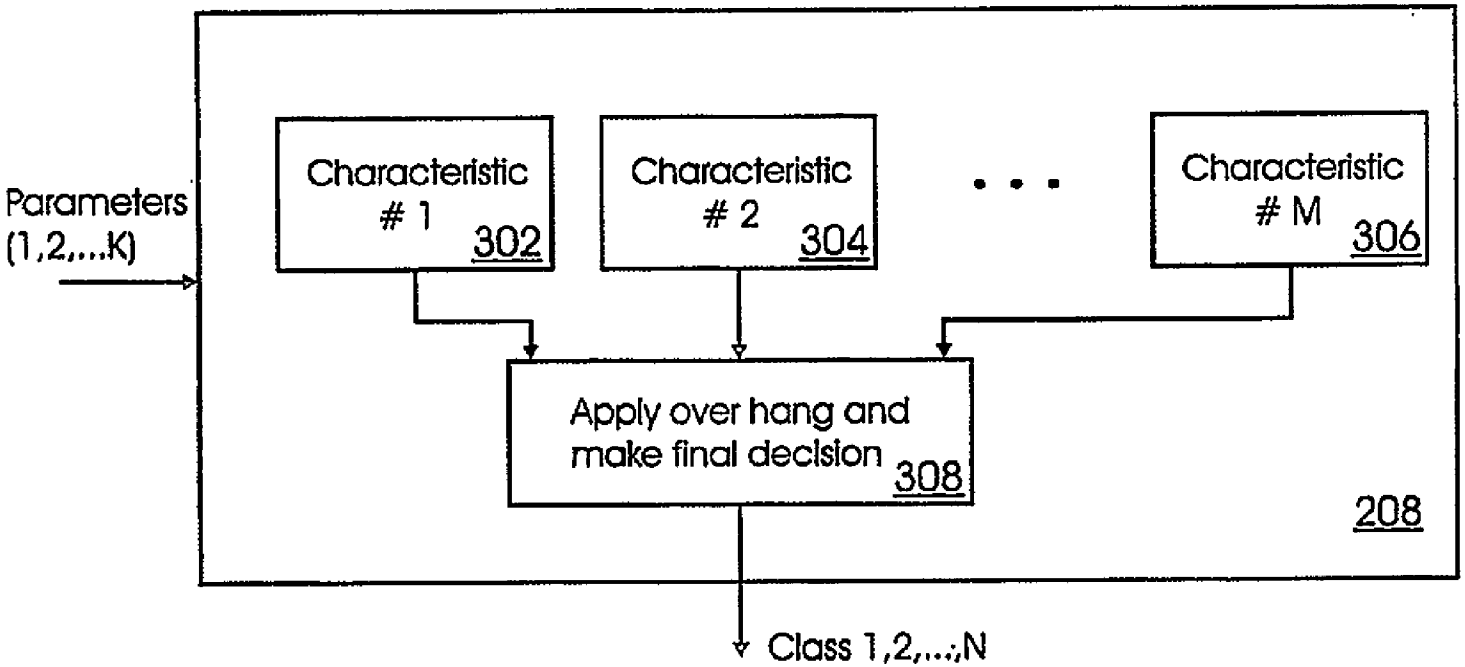
Figure 4A:
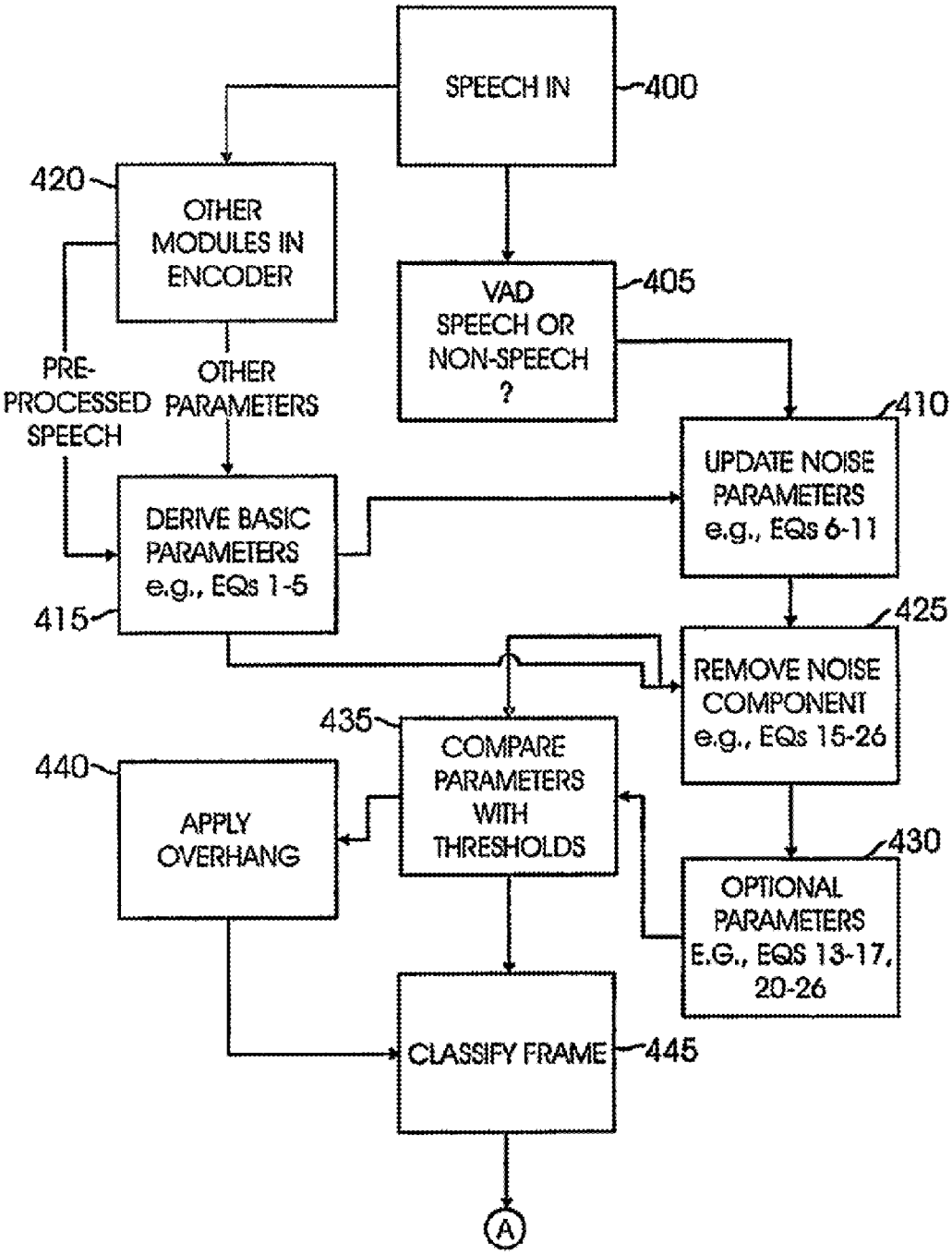
Figures 4, 4B:
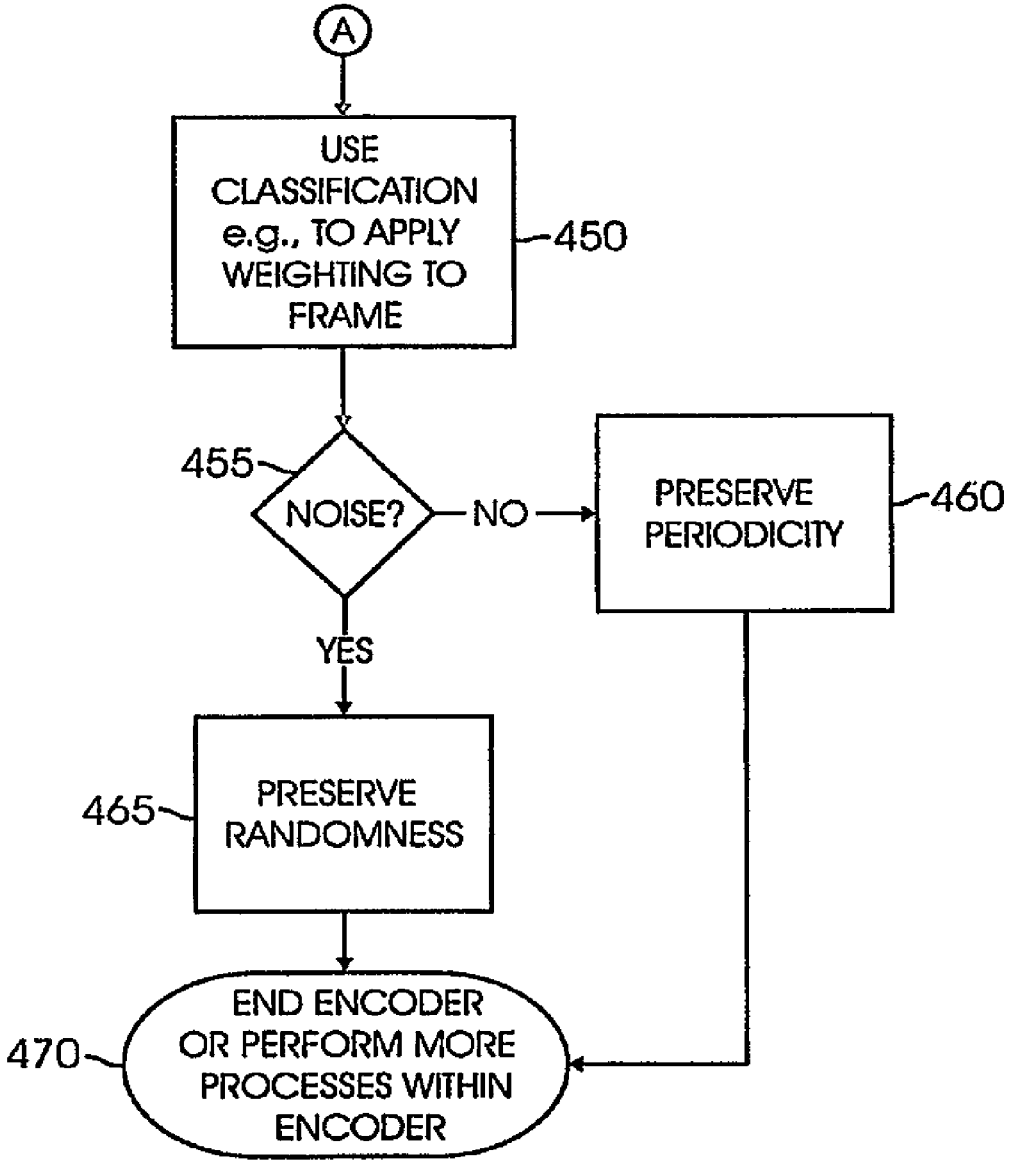

Referring now to FIG. 4, an exemplary module flow chart is illustrated in accordance with one embodiment of the present invention. The exemplary flow chart may be implemented using C code or any other suitable computer language known in the art. In general, the steps illustrated in FIG. 4 are similar to the foregoing disclosure.

A digitized speech signal is input to an encoder for processing and compression into the bitstream, or a bitstream into a decoder for reconstruction (step 400). The signal (usually frame by frame) may originate, for example, from a cellular phone (wireless), the Internet (voice over IP), or a telephone (PSTN). The present system is especially suited for low bit rate applications (4 kbits/s), but may be used for other bit rates as well.

The encoder may include several modules which perform different functions. For example, a VAD may indicate whether the input signal is speech or non-speech (step 405). Non-speech typically includes background noise, music and silence. Non-speech, such as background noise, is stationary and remains stationary. Speech, on the other hand, has pitch and thus the pitch correlation varies between sounds. For example, an "s" has very low pitch correlation, but an "a" has high pitch correlation. While FIG. 4 illustrates a VAD, it should be appreciated that in particular embodiments a VAD is not required. Some parameters could be derived prior to removing the noise component, and based on those parameters it is possible to estimate whether the frame is background noise or speech. The basic parameters are derived (step 415), however it should be appreciated that some of the parameters used for encoding may be calculated in different modules within the encoder. To avoid redundancy, those parameters are not recalculated in steps 415 (or subsequent steps 425, 430) but may be used to derive further parameters or just passed on to classification. Any number of basic parameters may be derived during this step, however, by way of example, previously disclosed equations 1–5 are suitable.

The information from the VAD (or its equivalent) indicates whether the frame is speech or non-speech. If the frame is non-speech, the noise parameters (e.g., the mean of the noise parameters) may be updated (step 410). Many variations of equations for the parameters of step 410 may be derived, however, by way of example, previously disclosed equations 6–11 are suitable. The present invention discloses a method for classifying which estimates the parameters of clean speech. This is advantageous, for among other reasons, because the ever-changing background noise will not significantly affect the optimal thresholds. The noise-free set of parameters is obtained by, for example, estimating and removing the noise component of the parameters (step 425). Again by way of example, previously disclosed equations 12–14 are suitable. Based upon the previous steps, additional parameters may or may not be derived (step 430). Many variations of additional parameters may be included for consideration, but by way of example, previously disclosed equations 15–26 are suitable.

Once the desired parameters are derived, the parameters are compared against a set of predetermined thresholds (step 435). The parameters may be compared individually or in combinations with other parameters. There are many conceivable methods for comparing the parameters, however, the previously disclosed series of "if-then" statements are suitable.

It may be desirable to apply an overhang (step 440). This simply allows the classifier to favor certain classes based on the knowledge of the history of the signal. Hereby, it becomes possible to take advantage of the knowledge of how speech signals evolve on a slightly longer term. The frame is now ready to be classified (step 445) into one of many different classes depending upon the application. By way of example, the previously disclosed classes (0–6) are suitable, but are in no way intended to limit the invention's applications.

The information from the classified frame can be used to further process the speech (step 450). In one embodiment, the classification is used to apply weighting to the frame (e.g., step 450) and in another embodiment, the classification is used to determine the bit rate (not shown). For example, it is often desirable to maintain the periodicity of voiced speech (step 460), but maintain the randomness (step 465) of noise and unvoiced speech (step 455). Many other uses for the class information will become apparent to those skilled in the art. Once all the processes have been completed within the encoder, the encoder's function is over (step 470) and the bits representing the signal frame may be transmitted to a decoder for reconstruction. Alternatively, the foregoing classification process may be performed at the decoder based on the decoded parameters and/or on the reconstructed signal.

The present invention is described herein in terms of functional block components and various processing steps. It should be appreciated that such functional blocks may be realized by any number of hardware components configured to perform the specified functions. For example, the present invention may employ various integrated circuit components, e.g., memory elements, digital signal processing elements, logic elements, look-up tables, and the like, which may carry out a variety of functions under the control of one or more microprocessors or other control devices. In addition, those skilled in the art will appreciate that the present invention may be practiced in conjunction with any number of data transmission protocols and that the system described herein is merely an exemplary application for the invention.

It should be appreciated that the particular implementations shown and described herein are illustrative of the invention and its best mode and are not intended to limit the scope of the present invention in any way. Indeed, for the sake of brevity, conventional techniques for signal processing, data transmission, signaling, and network control, and other functional aspects of the systems (and components of the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical communication system.

The present invention has been described above with reference to preferred embodiments. However, those skilled in the art having read this disclosure will recognize that changes and modifications may be made to the preferred embodiments without departing from the scope of the present invention. For example, similar forms may be added without departing from the spirit of the present invention. These and other changes or modifications are intended to be included within the scope of the present invention, as expressed in the following claims.

What is claimed is:

1. A method for classifying a speech signal having a background noise portion with a background noise level, the method comprising the steps of:

extracting a parameter from the speech signal;

estimating a noise component of the parameter;

removing the noise component from the parameter to generate a noise-free parameter;

selecting a pre-determined threshold, wherein the step of selecting said pre-determined threshold is unaffected by said background noise level;

comparing the noise-free parameter with a said pre-determined threshold; and associating the speech signal with a class in response to the comparing step;

wherein the extracting step extracts a plurality of parameters and the steps of estimating, removing selecting, comparing and associating are performed for each of the plurality of parameters, wherein the plurality of parameters include a spectral tilt parameter, a pitch correlation parameter and an absolute maximum parameter, and wherein said spectral tilt parameter is weighted to generate a noise-free spectral tilt parameter during the step of removing, said pitch correlation parameter is weighted to generate a noise-free pitch correlation parameter during the step of removing and said absolute maximum parameter is weighted to generate a noise-free absolute maximum parameter during the step of removing.

2. The method of claim 1, wherein weighting the parameter includes subtracting background noise contribution.

3. A method for processing a speech signal having a background noise portion with a background noise level, the method comprising the steps of:

extracting a set of speech parameters from the speech signal;

forming a set of noise-free parameters based on the speech parameters;

selecting a pre-determined set of thresholds, wherein the step of selecting said pre-determined set of thresholds is unaffected by said background noise level;

comparing each of the noise-free parameters with each corresponding threshold of said pre-determined set of thresholds; and classifying the speech signal based on the comparing step;

wherein the speech parameters include a spectral tilt parameter, a pitch correlation parameter and an absolute maximum parameter, and wherein said spectral tilt parameter is weighted to generate a noise-free spectral tilt parameter during the step of forming, said pitch correlation parameter is weighted to generate a noise-free pitch correlation parameter during the step of forming and said absolute maximum parameter is weighted to generate a noise-free absolute maximum parameter during the step of forming.

4. The method of claim 3, wherein the forming step comprises:

estimating a noise component of the speech signal; and removing the noise component from each of the speech parameters.

5. A speech coding device for classifying a speech signal having a background noise portion with a background noise level, the speech coding device comprising:

a parameter extractor module configured to extract a parameter from the speech signal to be used for classifying the speech signal;

a noise estimator module configured to estimate a noise component of the parameter;

a noise removal module configured to remove the noise component from the parameter to generate a noise-free parameter;

a comparator module configured to compare the noise-free parameter with a pre-determined threshold, wherein said pre-determined threshold is unaffected by said background noise level; and a classification module configured to associate the speech signal with a class in response to the comparator module;

wherein the parameter extractor module extracts a plurality of parameters and the noise estimator module, the noise removal module, the comparator module and classification module operate on each of the plurality of parameters, wherein the plurality of parameters include a spectral tilt parameter, a pitch correlation parameter and an absolute maximum parameter, and wherein the noise removal module weights said spectral tilt parameter to generate a noise-free spectral tilt parameter, the noise removal module weights said pitch correlation parameter to generate a noise-free pitch correlation parameter and the noise removal module weights said absolute maximum parameter to generate a noise-free absolute maximum parameter.

6. The speech coding device of claim 5, wherein weighting the parameter includes subtracting a background noise contribution.

7. A computer program product for classifying a speech signal having a background noise portion with a background noise level, the computer program product comprising:

code for extracting a parameter from the speech signal;

code for estimating a noise component of the parameter;

code for removing the noise component from the parameter to generate a noise-free parameter;

code for selecting a pre-determined threshold, wherein selection of said pre-determined threshold is unaffected by said background noise level;

code for comparing the noise-free parameter with said pre-determined threshold; and code for associating the speech signal with a class in response to the code for comparing;

wherein the code for extracting extracts a plurality of parameters and the code for estimating, removing, selecting, comparing and associating are performed for each of the plurality of parameters, and wherein the plurality of parameters include a spectral tilt parameter, a pitch correlation parameter and an absolute maximum parameter, and wherein the code for removing weights said spectral tilt parameter to generate a noise-free spectral tilt parameter, the code for removing weights said pitch correlation parameter to generate a noise-free Ditch correlation parameter and the code for removing weights said absolute maximum parameter to generate a noise-free absolute maximum parameter.

8. The computer program product of claim 7, wherein the code for applying weighting includes code for subtracting a background noise contribution.

* * * * *

UNITED STATES PATENT AND TRADEMARK OFFICE

CERTIFICATE OF CORRECTION

PATENT NO. : 6,983,242 B1
APPLICATION NO. : 09/643017
DATED : January 3, 2006
INVENTOR(S) : Jes Thyssen It is certified that error appears in the above-identified patent and that said Letters Patent is hereby corrected as shown below:

In the drawings, Figures 1, 2, 3, and 4 should be replaced by Figures 1, 2, 3, 4A and 4B.

Signed and Sealed this

Twentieth Day of February, 2007

JON W. DUDAS
*Director of the United States Patent and Trademark Office*

4A
4B